US005740005A

United States Patent [19]

Chen et al.

[11] Patent Number: 5,740,005

[45] Date of Patent: Apr. 14, 1998

[54] SOLENOID VALVE BOOSTER

[76] Inventors: Chun-Chun Chen, 3F, No. 40, Lane 1448, Jung Hua Road, Chupei, Hsinchu Hsien; Chih-Shun Chuang, 36, Lane 40, San Duo 4th Road, Kaohsiun; Winifred Yu-Chuang Lin, 6F, No. 1, Lane 35, Ju Guang Road, Hsinchu, all of Taiwan

[21] Appl. No.: 848,279

[22] Filed: Apr. 29, 1997

[51] Int. Cl.[6] ..... H01H 47/04

[52] U.S. Cl. ..... 361/160

[58] Field of Search ..... 361/152–156, 361/160

[56] References Cited

U.S. PATENT DOCUMENTS 4,291,358 9/1981 Dettman et al. ..... 361/154

4,432,034 2/1984 Wohlert et al. ..... 361/154

4,812,945 3/1989 D'Onofrio ..... 361/154

5,347,421 9/1994 Alexanian ..... 361/154

*Primary Examiner*—Fritz Fleming

*Attorney, Agent, or Firm*—Bacon & Thomas

[57] ABSTRACT

A solenoid valve booster includes a control circuit connected between an input of a solenoid valve and AC power. The control circuit is consisted of a positive half wave turn-on voltage control circuit, a negative half wave turn-off delay control circuit, a logic NOR gate circuit, a phase control circuit, a rectifying and filtering circuit, and a start delay circuit. It can reinforce opening force of the solenoid valve, and lessening power consumed by the solenoid valve. Further, an isolate start circuit and an input control may be additionally connected with the booster described above for taking place of a conventional SSR (solid state relay).

2 Claims, 6 Drawing Sheets

SOLENOID VALVE BOOSTER

BACKGROUND OF THE INVENTION

This invention related to a solenoid valve booster, particularly to one with a small dimensions, of low cost, durable, power-efficient to minimize power consumed by a solenoid valve, convenient to be applied to common solenoid valves in market or in use, able to reinforce opening force of the solenoid valve and at the same time lowering power loss in maintaining the solenoid valve in an opened condition.

As industries have developed with fast steps, automation of machines has become very prevalent. So solenoid valves have been widely used and its demand is growing and growing, able to take place of manual work, especially at dangerous locations for avoiding accidents. When production lines in factories have to stop immediately in case of power outage or any ether emergency, a solenoid valve can perform its function for that purpose. And automatic manufacturing machines absolutely need a solenoid valve for supplying fluid for air or oil pressure cylinders to operate. It is quite evident that solenoid valves are indispensable components for automation in industries such as chemical industry, machine industry, pharmaceutical industry, semiconductor industry, etc. Therefore, the quality of solenoid valves have a close relation with automatic equipment.

At present, solenoid valves maybe classified into two kinds, AC power source and DC power source, and the solenoid valves are used in two ways. The first way is to connect a switch between power source and a solenoid valve for turning on and off the solenoid valve in opening or closing it. The second way is to connect a SSR (solid state relay) between a solenoid valve and a power source, and when the SSR gets 3 V to 40 V DC power source at its input, the solenoid valve gets through with AC power source to open the solenoid valve. Otherwise, the power source is cut off the solenoid valve by the SSR. So computers or electronic circuits can utilize the second way for controlling a solenoid valve, and further can be automatically controlled. Simple or manual control adopts the first way for controlling a solenoid valve.

DC solenoid valves need a rectifying circuit, and besides, its opening pressure is generally lower than AC ones (at present DC solenoid valves in market are such). So they are not so popular as AC ones.

However, conventional AC solenoid valves are found to have the following disadvantages in practical use.

1. Generally speaking, power and current needed in a moment when a solenoid valve is opened is rather larger than that needed in maintaining the solenoid valve in an opened condition. As to those available in market now, their opening power is one and a half times to three times of their maintaining power being in the scope of 9 W to 45 W. But practically, maintaining power may be only 0.2 W to 3 W, which is a fact well known to research sectors of solenoid valves, but not yet improved. Possible reason may be that the solenoid valve needs powerful magnetic force to resist pressure of a fluid, and sufficient electric current has to be supplied to the coil of a solenoid valve. If the current for the coil is lowered, power for maintaining the solenoid valve can also be lowered, but the pressure of the fluid opened by the solenoid valve can also be lowered. This is one disadvantages solenoid valves have, i.e. power needed for maintaining the solenoid valve in an opened condition is high, resulting in high cost, and in addition, the housing and the coil of the solenoid valve are also warmed up to lower its service life.

2. The second disadvantage is the direction of a fluid flow is definite, i.e. the fluid can only flow from the input to the output. Provided that the pressure value of the fluid at the output is larger than that at the input, the valve gate of the solenoid valve cannot be shut, but always in an opened condition.

3. The third disadvantage is the noise produced by the frequency 60 Hz caused by design or pollution or corrosion, with probable reasons as follows.

(1) FIGS. 1, 2 show an opening and closing movement of a solenoid valve A. When electricity gets through the valve A, a coil in a housing B immediately produces magnetic force to activate a piston D of a valve gate C to move to collide with a copper ring E and open the valve gate C, permitting a fluid to flow through the gate C.

(2) FIG. 2 shows the piston D blocks the gate C, preventing fluid from passing therethrough when the solenoid valve does not get electricity.

(3) The copper ring E has its function to be described later, but still has a drawback that copper is liable to be corroded by fluid, so its marketability largely decreased, unable to be used in chemical industry. Although the copper ring E is located at a rear end of the ring E, fluid can still invade the copper ring E. Then solenoid valves provided with this copper ring may be liable to become out of order.

(4) If a solenoid valve A does not have a copper ring E, a piston D will be repeatedly attracted and repelled to produce hitting noise against the valve body, as can be seen in FIGS. 3 and 4. FIG. 3 shows hysteresis loop of induction of an iron magnet material in the magnetic field produced by a coil. FIG. 4 shows the relation of B (magnetic field flux density) with H (magnetic induction). The section ab of the curve represents the piston completely not magnetized at the point a and a little magnetized at the point b. Then when H externally added gradually disappears, B in the piston does not disappear in accordance with H, but only diminishes a little (as shown in the section bc). When H completely disappears (at the point c), the piston still has some B circulating in the same direction of original H along the route d-e-b-c-d. In the alteration process just mentioned above, it is evident that H gradually diminishes and finally disappears (as shown in the section bc), but B in the piston does not completely disappear until it reaches to the point i, i.e. delays to the point i. This phenomenon is called hysteresis and FIG. 3 shows hysteresis loop.

(5) From FIG. 4 it can be understood that H and B follow with each other in the same direction for the most time, i.e. having attracting force, but having repelling force for some time near the point O of H as to produce hitting noise by the piston against the valve body.

(6) If a solenoid valve has a copper ring E, according to LENZ' law the copper ring E produces resistant reverse H in relation to H externally added, in proportion to the alteration rate dH/dt of H externally added. So the resistant reverse H is very little on the flat section, but very large near the point O, and thus H only diminishes a little in attracting force, but very much near the point O, i.e. repelling force diminishes for a large extent. In other words, the hitting noise is lowered substantially.

(7) As can be understood from the items (1) to (6), solenoid valves all have a drawback whether or not they are provided with a copper ring, and this is the third disadvantage of AC solenoid valves available at present.

SUMMARY OF THE INVENTION

One purpose of the invention is to offer a solenoid valve booster, which can reinforce opening force of a solenoid valve and diminish power loss for maintaining the solenoid valve in an opened condition, applicable to solenoid valves available in market at present.

Another purpose of the invention is to offer a solenoid valve booster, which has a small dimensions, a low cost, a long service life, and effectiveness in saving electricity.

The main feature of the invention is a control circuit including a positive half wave turn-on voltage control circuit, a negative half wave turn-off delay control circuit, a logic NOR gate circuit, a phase control circuit, a rectifying and filtering circuit, and a start delay circuit properly connected together. In addition, a separate start circuit and an input control can be added to the control circuit so as to open and close the solenoid valve by inputting a DC voltage signal.

BRIEF DESCRIPTION OF DRAWINGS

This invention will be better understood by referring to the accompanying drawings, wherein.

DESCRIPTION OF THE PREFERRED EMBODIMENT

Figure 5:
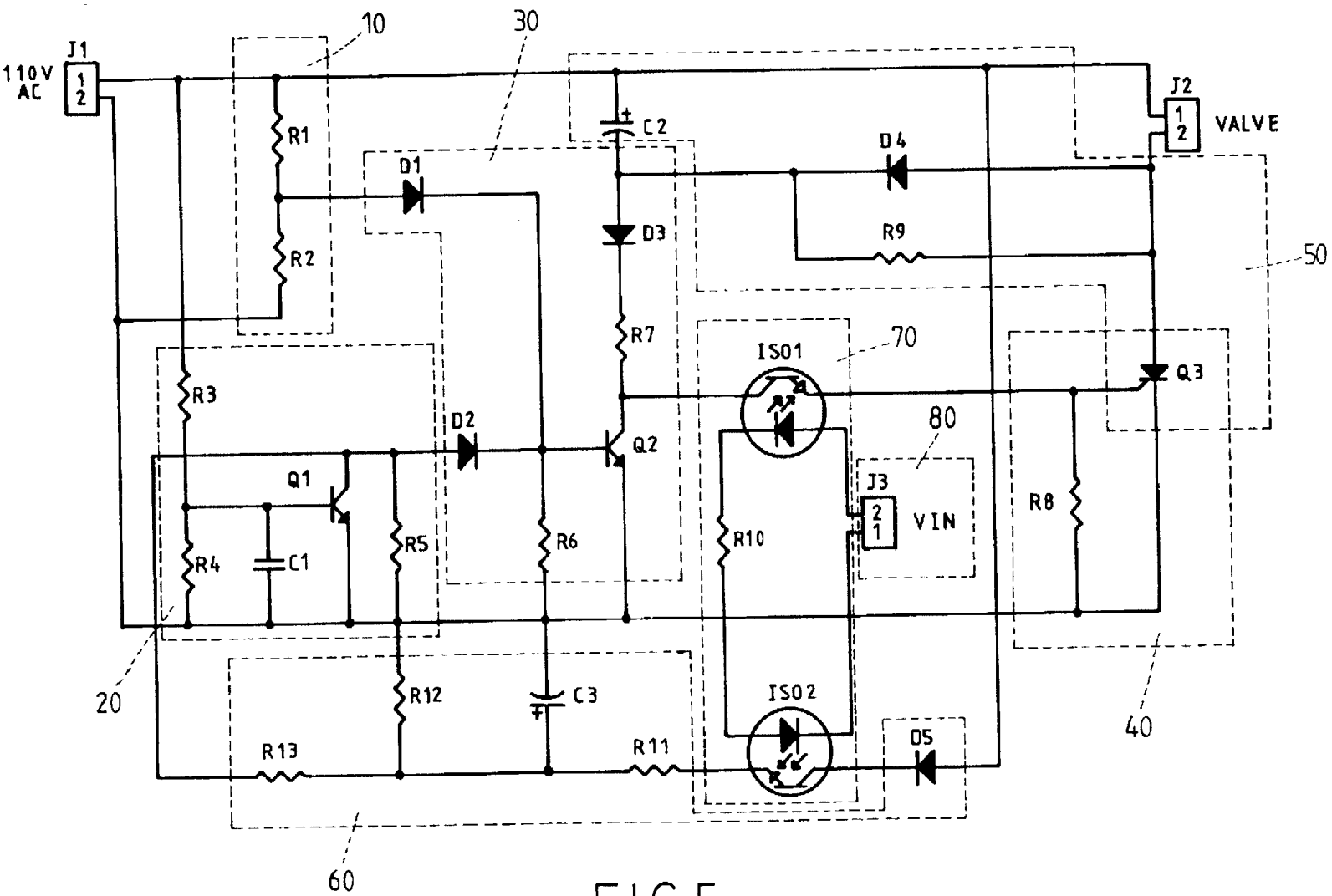
FIG. 5 is a diagram of an electronic circuit of the preferred embodiment of a solenoid valve booster in the present invention.
Figure 6:
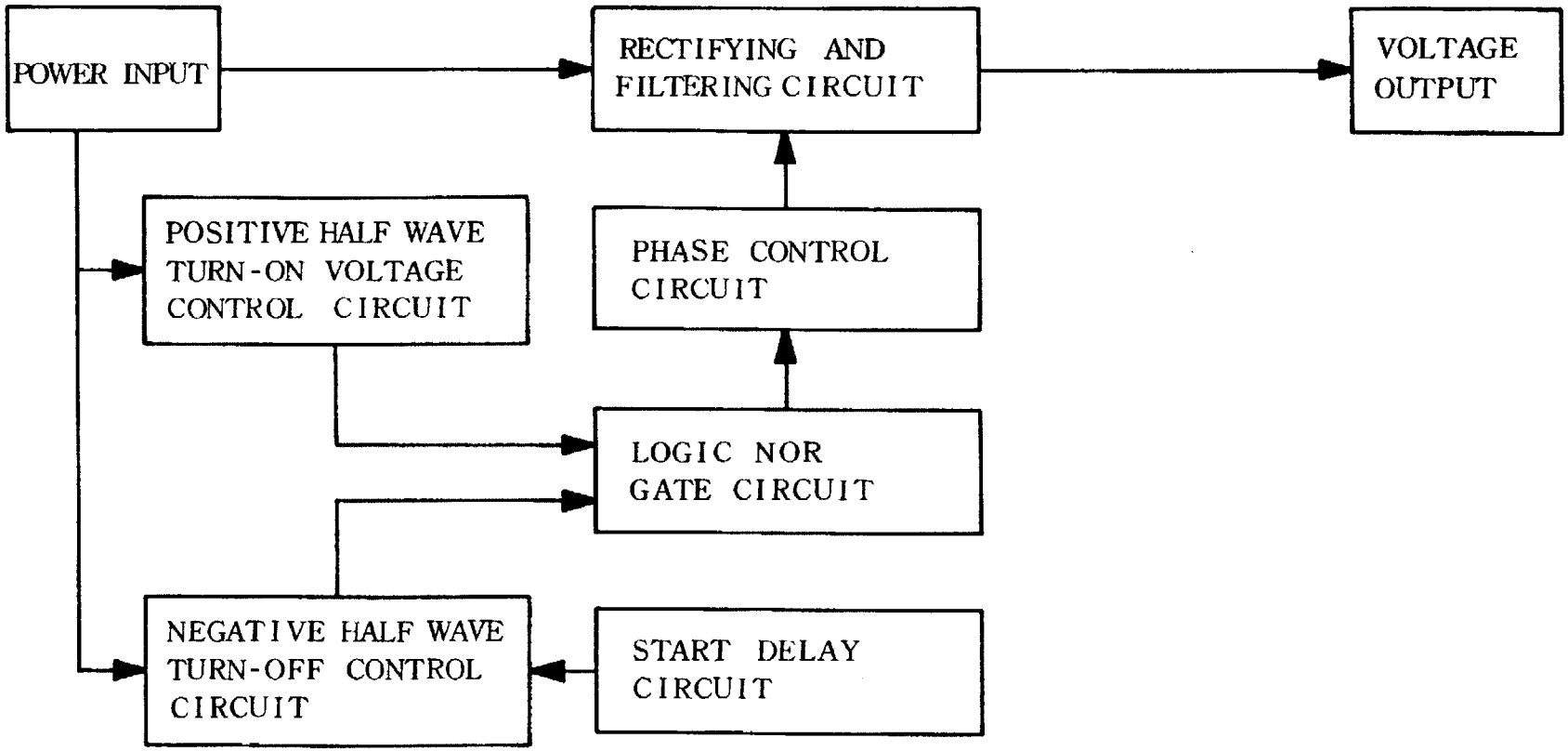
FIG. 6 is a block diagram of the preferred embodiment of a solenoid valve booster in the present invention.
Figure 7:
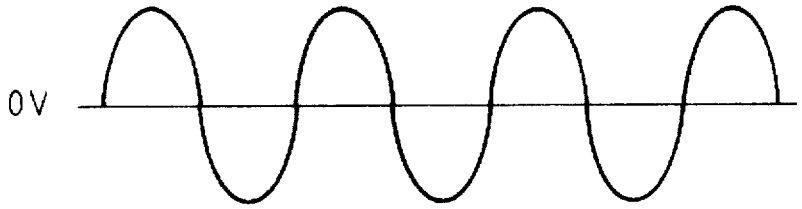
FIG. 7 is a graph of the wave of AC power source.

A preferred embodiment of a solenoid valve booster in the present invention, as shown in FIGS. 5 and 6, includes a positive half wave turn-on voltage control circuit 10, a negative half wave turn-off control circuit 20, a logic NOR gate circuit 30, a phase control circuit 40, a rectifying and filtering circuit 50 and a start delay circuit 60 combined together.

Figure 8:
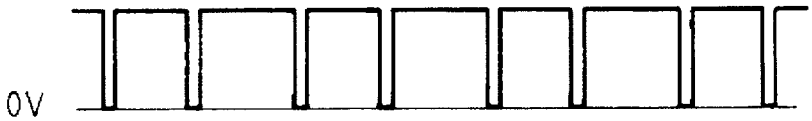
FIG. 8 is a graph of the related output of a positive half wave turn-on voltage control circuit of the solenoid valve booster in the present invention.

The positive half wave turn-on voltage control circuit 10 is formed of resistors R1, R2, functioning to send out an output of low voltage during a positive half wave of AC power source and in case of its voltage lower than the preset value. On the other hand, if the voltage is higher than the preset value, the output is high voltage, and its integral related output wave is shown in FIG. 8.

Figure 9:
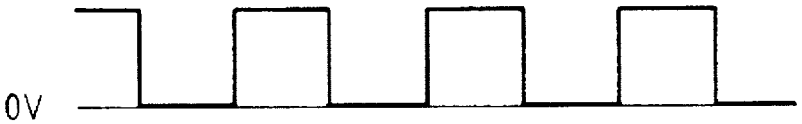
FIG. 9 is a graph of the related output of a negative half wave turn-off control circuit of the solenoid valve booster in the present invention.

The negative half wave turn-off delay control circuit 20 is made up of two resistors R3, R4, a capacitor C1, and a transistor Q1, functioning to send out an output of low voltage during a positive half wave of AC power source and an output of high voltage during a negative half wave of AC power source, and its output wave is delayed for several milliseconds later than that of AC power source, and its graph is shown in FIG. 9.

Figure 10:
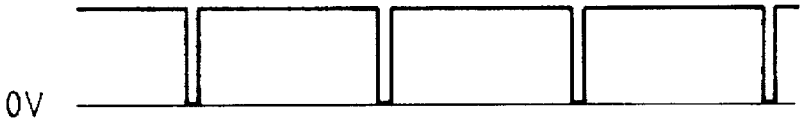
FIG. 10 is a graph of the related output of a logic NOR gate circuit of the solenoid valve booster in the present invention.

The logic NOR gate circuit 30 is made up of two resistors R6, R7, three diodes D1, D2, D3 and a transistor Q2, connected with the output of the positive half wave turn-on voltage control circuit 10 and the negative half wave turn-off control circuit 20. So if one of the two outputs of the two circuits 10, and 20 is high voltage, the logic NOR gate circuit 30 sends out an output of low voltage. And if both the two outputs of the two circuits 10, 20 are low voltage, the logic NOR gate circuit 30 sends out an output of high voltage, and its wave graph is shown in FIG. 10.

The phase control circuit 40 is made up of a resistor R8 and a SCR Q3, connected with the output of the logic NOR gate circuit 30, turned on to send out an output of high voltage only if the output of the logic NOR gate circuit 30 is high voltage.

The rectifying and filtering circuit 50 is made up of a resistor R9, a capacitor C2, a diode D4 and a SCR Q3, connected with the output of the phase control circuit 40, i.e. controlled by the circuit 40. When the phase control circuit 40 is cut off, it permits a positive half wave of AC power source pass through (or rectified) and filtered.

Figure 11:
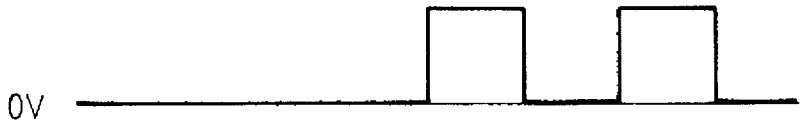
FIG. 11 is a graph of the related output of the negative half wave turn-off delay control circuit at the beginning of electricity flowing the same circuit.
Figure 12:
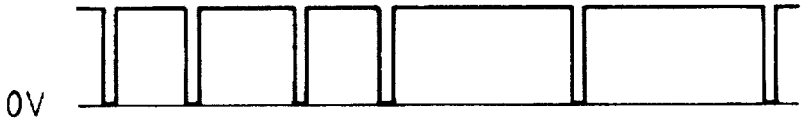
FIG. 12 is a graph of the output of the logic NOR gate circuit related to that of the negative half wave turn-off delay circuit in FIG. 11.

The start delay circuit 60 is made up of three resistors R11, R12, R13, a capacitor C3 and a diode D5, controlling the output of the negative half wave turn-off delay control circuit 20 to delay the output. So the output of the negative half wave turn-off delay control circuit 20 is maintained as low voltage, whether AC power source is a positive half wave or a negative half wave during tens of milliseconds of input of AC power source. In other words, during tens of milliseconds the negative half wave turn-off delay control circuit 20 does not work normally, and its wave is shown in FIG. 11, and the output of the logic NOR gate circuit is shown in FIG. 12.

The above description of the invention concerns interrelation of the main parts, and of course, a complete circuit includes a power source input and a voltage output, which are not included in the invention, not to be described here. The power source input is shown in FIG. 5, represented by J1, an AC power source input terminal of voltage of 110 V or 220 V, frequency 50 or 60 Hz, and the voltageoutput is represented by J2, connected with a power cord of the solenoid valve.

Figure 13:
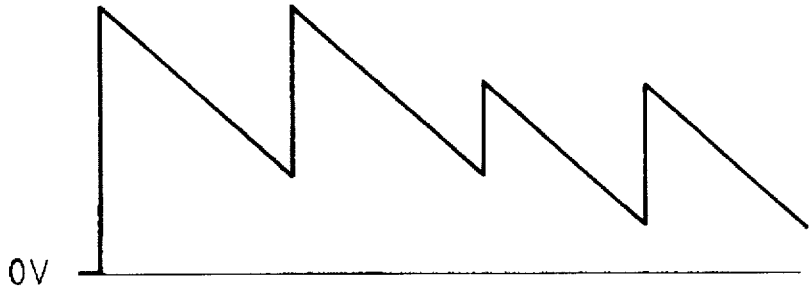
FIG. 13 is a graph of the voltage of a coil of the solenoid valve booster in the present invention; and, FIG. 14 is a block diagram of an enlarged preferred embodiment of the solenoid valve booster in the present invention.
Figure 14:
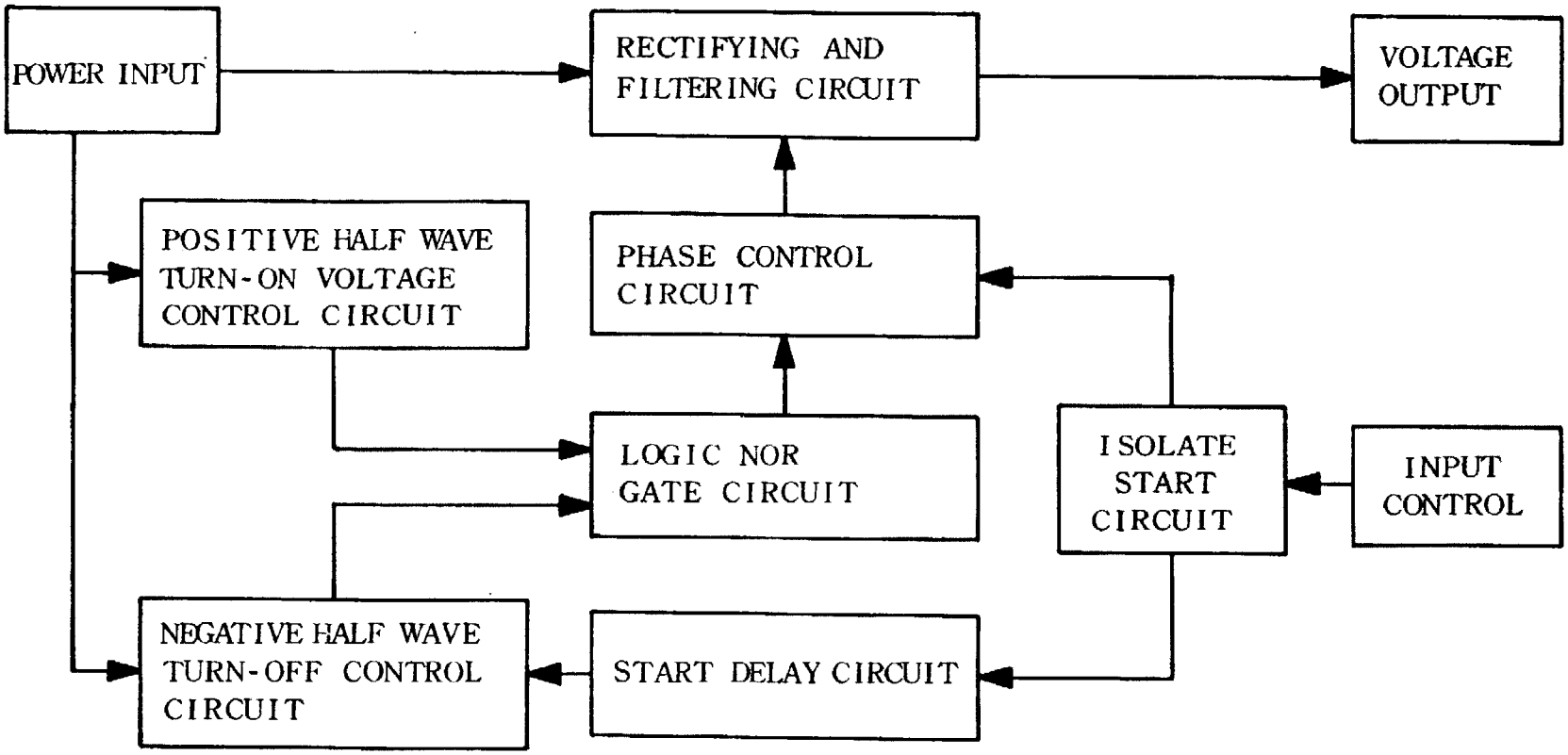

In operation, the moment when the solenoid valve booster is electrified, a positive half wave of AC power source is all supplied to the coil of a solenoid valve, producing magnetic force, and average voltage at the moment is the highest, so the got magnetic force is the largest to increase opening force of the solenoid valve, and thus increasing pressure value of fluid opened. FIG. 13 shows two front waves of the moment voltage at opening of the solenoid valve. After tens of milliseconds, the negative half wave turn-off delay control circuit 20 recovers its normal function, lowering average voltage to the value only needed for maintaining an opened condition of the solenoid valve, and its two front waves is shown in FIG. 13.

Figure 1:
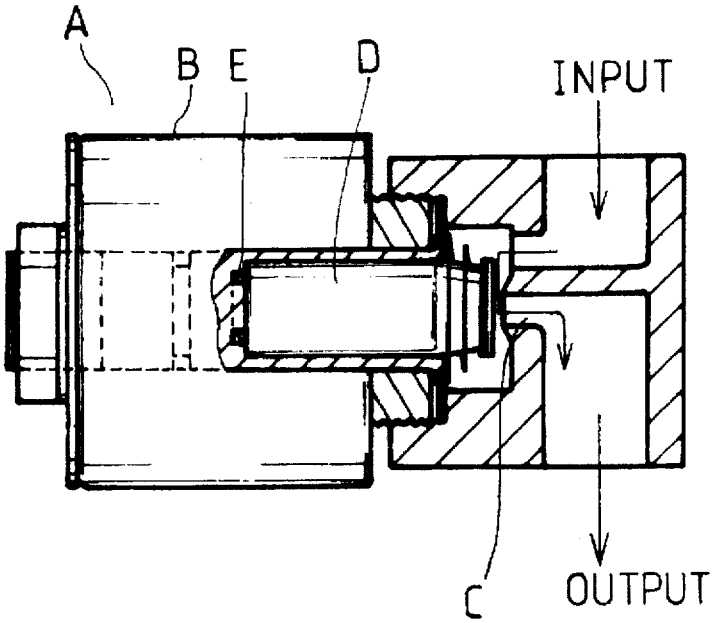
FIG. 1 is a cross-sectional view of a preferred embodiment of a solenoid valve booster in the present invention, showing it in an opened condition.
Figure 2:
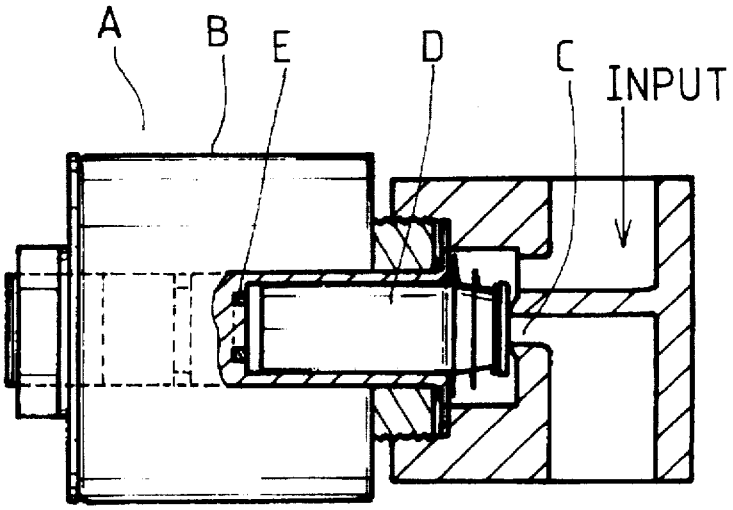
FIG. 2 is a cross-sectional view of the preferred embodiment of a solenoid valve booster in the present invention, showing it in a closed condition.
Figure 3:
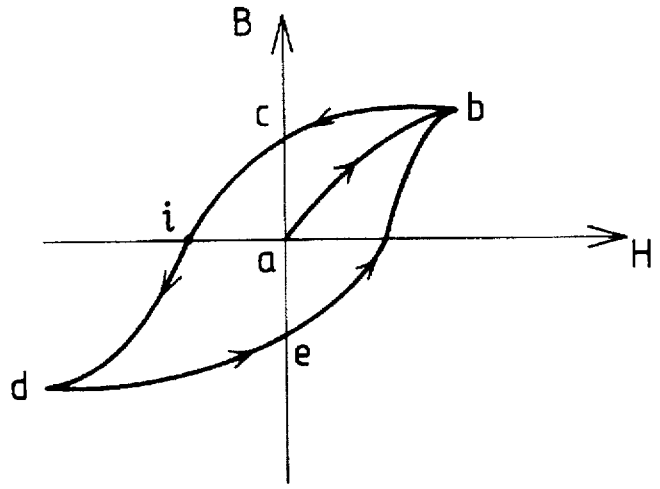
FIG. 3 is a graph of hysteresis phenomenon.
Figure 4:
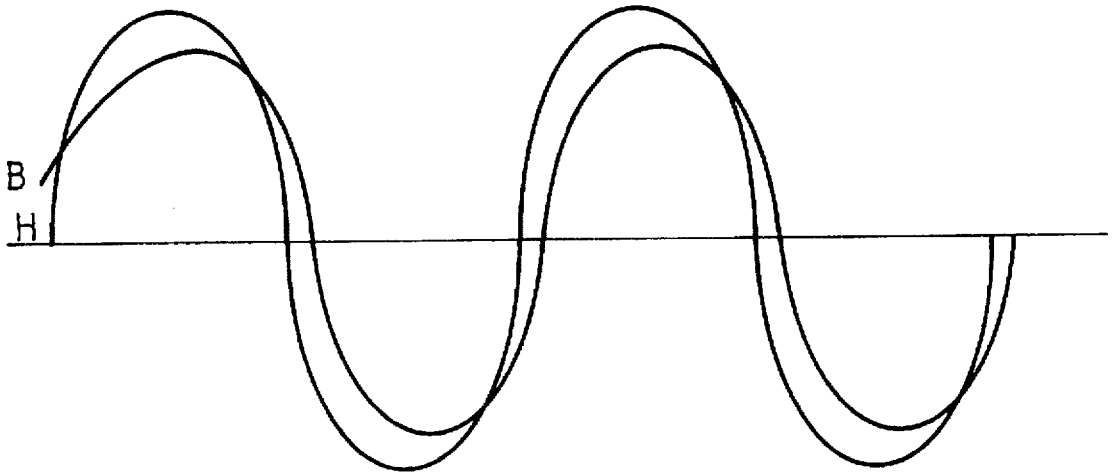
FIG. 4 is a graph of the relation of B (magnetic field flux density) and H (magnetic induction) in FIG. 3.

Now, when a conventional AC solenoid valve is activated by AC power source, the piston D of the solenoid valve A produces one suck and one push movement alternately by positive and negative half waves of AC power source as as shown in FIG. 4. So general sucking force of the conventional solenoid valve is lower than that of the solenoid valve combined with the booster of the invention, which then can not only increase pressure value of the fluid opened by itself, but also lower loss of power for maintaining the solenoid valve in an opened condition (as the negative half wave turn-off delay control circuit 20 already recovers its normal operation). That is to say, loss of power may be lessened, i.e. the invention can reinforce opening force of the solenoid valve, saving electricity.

As can be understood from the above description, the booster of the invention can not merely be set between a conventional solenoid valve in use at present and an AC power source, but also can automatically start it in the same way a solenoid valve is not provided with the booster of the present invention. Besides, it can be used to replace the second conventional solenoid valve mentioned above, the conventional SSR (solid state relay) as well, by adding an isolate start circuit 70 and an input control 80 therein to be described below.

The isolate start circuit 70 is consisted of a resistor R10 and two optocouplers ISO1, ISO2, having its output connected respectively with the phase control circuit 40 and the start delay circuit 60, under control of the input control 80.

The input control 80 is located at the symbol J3 in FIG. 5. When DC signal of 3 V to 40 V is fed to the input control 80, the isolate start circuit 70 can be activated to work, opening the solenoid valve in the same way as described above. Cessation of the DC signal closes immediately the solenoid valve.

As described above, the second conventional method for controlling a solenoid valve is performed by the SSR, with 3 V to 40 V DC power source fed to the input of the SSR for opening the solenoid valve. However, the booster additionally connected with the separate start circuit 70 and the input control 80 in the invention can take place of the conventional SSR. And the solenoid valve can also be controlled by 3 V to 40 V DC power source in the same way the SSR does.

As can be understood from the above description, the solenoid valve booster in the present invention surely reinforces opening force of the solenoid valve, and lessens loss of power for maintaining the solenoid valve in an opened condition. At the same time, it has a small dimensions than solenoid valves of the same class, its cost cheaper, effective in saving electricity, with a small power able to maintain opening condition of the solenoid valve, not causing extra power consumed as to warm up the housing and the coil of the solenoid valve, prolonging service life of the solenoid valve. Besides, it can be applied to special machines because of reinforcing opening force, with the input and the output able to communicate with each other under the opening pressure of the fluid, improving the second drawback of the conventional solenoid valve. In addition, it does not have the third drawback of the conventional solenoid valve, provided with a rectifying and filtering circuit.

While the preferred embodiment of the invention has been described above, it will be recognized and understood that various modifications may be made therein and the appended claims are intended to cover all such modifications which may fall within the spirit and scope of the invention.

I claim:

1. A solenoid valve booster comprising a control circuit connected between an power input of a solenoid valve and an AC power source;

said control circuit comprising:

a positive half wave turn-on voltage control circuit made up of two resistors R1, R2, connected with an input of said AC power source, outputting a voltage value to a logic NOR gate circuit;

a negative half wave turn-off delay control circuit made up of three resistors R3, R4, R5, a capacitor C1 and a transistor Q1, connected with the input of said AC power source, outputting a voltage value to said logic NOR gate circuit;

said logic NOR gate circuit made up of two resistors R6, R7, three diodes D1, D2, D3 and a transistor Q2, connected with an output of said positive half wave turn-on voltage control circuit and said negative half wave turn-off delay control circuit, outputting a voltage value value to a phase control circuit;

said phase control circuit made up of a resistor R8 and a SCR Q3, connected with an output of said logic NOR gate circuit, conducting a source to a rectifying and filtering circuit;

said rectifying and filtering circuit made up of a resistor R9, a capacitor C2, a diode D4 and a SCR Q3, connected with an input of said phase control circuit, performing or stopping filtering work in accordance with alteration of the input voltage of said phase control circuit; and, a start delay circuit made up of three resistors R11, R12, R13, a capacitor C3 and a diode D5, controlling the output of said negative half wave turn-off delay control circuit so that said negative half wave turn-off delay circuit control may not function during tens of milliseconds when AC power source is inputted, but be delayed in sending its output;

a whole positive half wave of AC power source supplied to a coil of a solenoid valve at the moment when said solenoid valve booster is electrified, average voltage being the highest at that moment, said coil providing the largest magnetic force as to increase opening force of said solenoid valve and thereby increase pressure value of fluid opened by said solenoid valve, said negative half wave turn-off delay control circuit recovering normal work after tens of milliseconds so that average voltage may be lowered as low as a value enough for maintaining the opened condition of said solenoid valve, said solenoid valve thus able to be kept opened with a low power consumption with little loss of power.

2. The solenoid valve booster as claimed in claim 1, wherein further an isolate start circuit made up of a resistor R10 and two optocouplers ISO1, ISO2, and an input control are additionally connected respectively with said phase control circuit and said start delay circuit and feed their outputs respectively to the related circuit for performing shutting and opening of said solenoid valve, taking place of a conventional SSR (solid state relay).

* * * * *